United States Patent [19]

Kozlov et al.

[11] Patent Number: 4,936,274

[45] Date of Patent: Jun. 26, 1990

[54] HEAT ENGINE SPEED GOVERNOR

[76] Inventors: Anatoly V. Kozlov, ulitsa 12-ya Krasnoarmeiskaya, 2I, kv. 23; Jury F. Khaimin, Volkovsky prospekt, 110, kv. 106; Grigory Y. Vainshtein, Volkovsky prospekt, II0, kv.65, all of Leningrad; Vladimir I. Marakin, Novosibirsky raion, poselok Krasnoobsk, 49, kv.6., Novosibirskayaoblast, all of U.S.S.R.

[21] Appl. No.: 271,960

[22] PCT Filed: Jan. 27, 1987

[86] PCT No.: PCT/SU87/00010

§ 371 Date: Sep. 26, 1988

§ 102(e) Date: Sep. 26, 1988

[87] PCT Pub. No.: WO88/05568

PCT Pub. Date: Jul. 28, 1988

[51] Int. Cl.[5] ..... F02D 31/00

[52] U.S. Cl. ..... 123/350; 123/352

[58] Field of Search ..... 123/350, 352, 357, 361

[56] References Cited

U.S. PATENT DOCUMENTS 4,304,202 12/1981 Schofield ..... 123/350
4,461,254 7/1984 Pfalzgraf ..... 123/350

FOREIGN PATENT DOCUMENTS 708065 1/1980 U.S.S.R. .
1544246 4/1979 United Kingdom .

OTHER PUBLICATIONS

"Fridman-Mayer", Symposium, Austira pub. 01/16/84 (Leningrad): Report by F. Pashke, Development of Electronic Governor, P4-5, FIG. 17.

Symposium of "Robert Bosch", Company BRD, pub. 05/16/84 (Moscow): Report by K. Zimmerman, Diesel Equipment of the Bosch Company (FIGS. 17 & 22).

*Primary Examiner*—Andrew M. Dolinar
*Attorney, Agent, or Firm*—Lilling and Greenspan

[57] ABSTRACT

A heat engine speed governor, includes an electric motor of unidirectional rotation kinematically connected to an input shaft of a differential mechanism, the other input shaft of which is rotated by a heat engine, while the output shaft is kinematically connected to a fuel dosing device of the heat engine. In the channel for controlling the rotational speed of the electric motor, the speed meter measuring the rotational speed of the heat engine is connected to the input of a comparison unit whose input is connected to the output of a program forming unit forming a program of controlling the electric motor speed. The output of the comparison unit is connected to the input of an integrator whose output is connected to the input of the unit forming a control signal. The setting input of the control signal forming unit is connected to the output of the program forming unit while the output is electrically connected to the electric motor. Connected to the input of the control signal forming unit is a channel for correction of the speed of the electric motor under transient conditions following the speed of the heat engine.

8 Claims, 1 Drawing Sheet

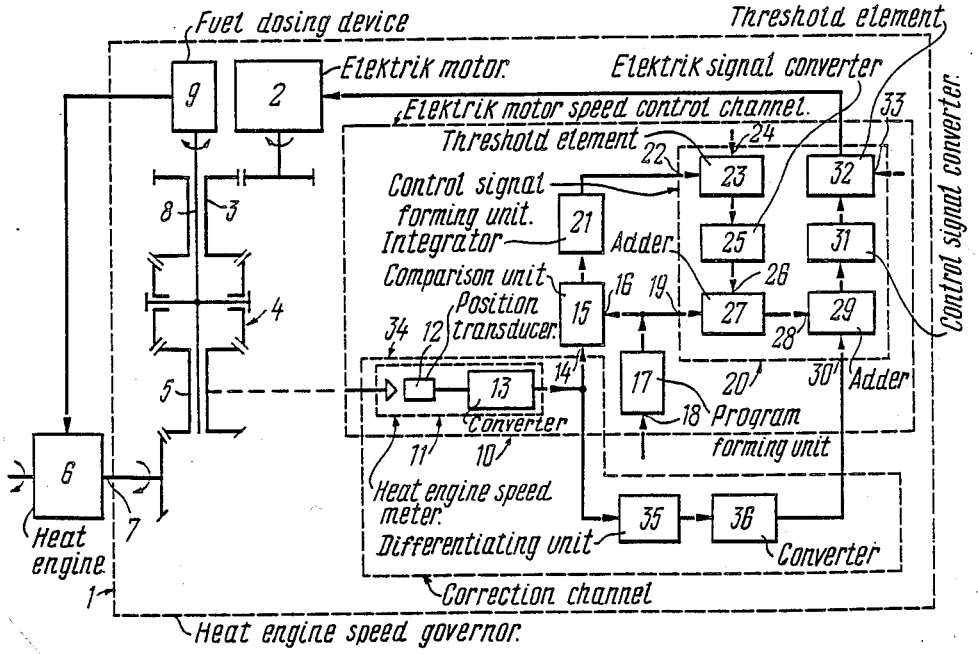

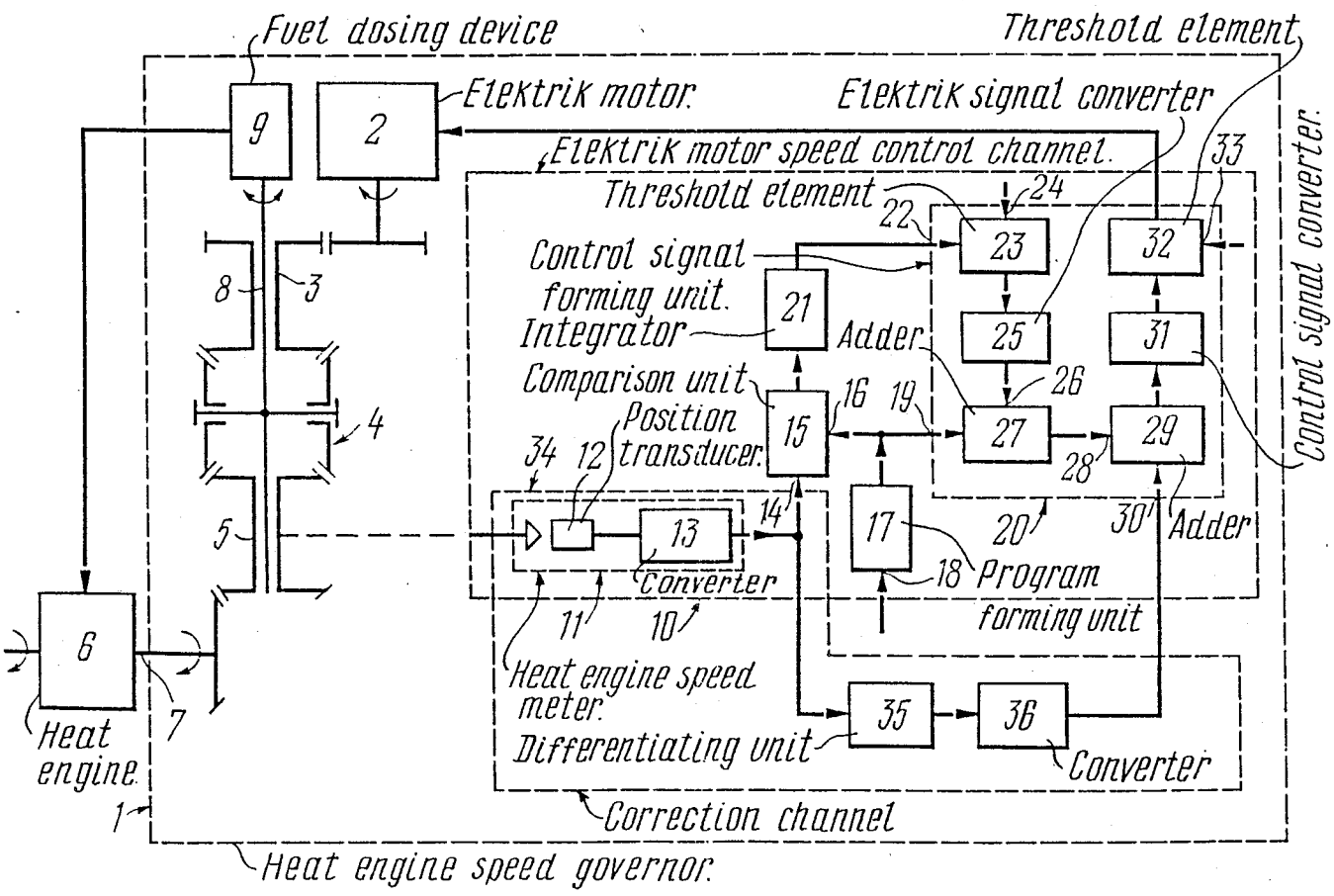
Threshold element
Control signal converter
Elektrik signal converter
Elektrik motor speed control channel.
Elektrik motor.
Fuel dosing device
Threshold element
Control signal forming unit.
Integrator
Adder
Comparison unit
Position transducer.
Program forming unit
Converter
Heat engine speed meter.
Differentiating unit
Converter
Correction channel
Heat engine speed governor.
Heat engine
Adder
1
2
3
4
5
6
7
8
9
10
11
12
13
14
15
16
17
18
19
20
21
22
23
24
25
26
27
28
29
30
31
32
33
34
35
36

HEAT ENGINE SPEED GOVERNOR

TECHNICAL FIELD

The present invention relates to heat engines and, more particularly, the invention relates to a heat engine speed governor.

DESCRIPTION OF THE PRIOR ART

The most important technical characteristics of a machine with a heat engine are reliability, output capacity, low fuel consumption, quality of performing the technological operations by the machine, content of smoke in the exhaust and toxicity of the flue gases under transient operating conditions, amount of operations performed by the driver and a force applied to the accelerator pedal of the vehicle, fitness of the heat engine to different kinds of fuel, high mountain conditions, low ambient temperatures and other parameters. The above characteristics largely depend on the properties of the speed governor of the heat engine.

The present-day heat engines, in particular tractor and automotive engines, are equipped mainly with mechanical governors having a centrifugal-type sensing element. In order to improve the automatic control of the vehicle, these governors are equipped with special-purpose electric drives including a reversible electric motor for controlling the speed of the heat engine, an electric motor for limiting the fuel supply, an electric magnet device for increasing the fuel supply when starting the heat engine, and an electrohydraulic valve to cut off the fuel supply when stopping the heat engine.

The prior art mechanical, hydraulic and pneumatic governors do not meet the permanently increasing requirements to the level of automation of controlling the fuel supply of a heat engine. Furthermore, the modern governors must maintain a preset speed of the heat engine with a high accuracy under steady-state conditions (with permissible tolerance within ±0.25% of the rated value), which cannot be maintained by means of the above governors. Therefore, studies are being conducted to develop an electrical governor capable of improving the automatic control of a heat engine and providing a high accuracy of maintaining a preset speed of the heat engine due to flexible adjustment of the control elements of the governor and application of corrective feedback. The static, dynamic and functional characteristics of the automatic speed control system of a heat engine are set by forming a program of control of an actuating electric drive. The type of this program depends on the application of the machine unit with a heat engine, nature of the machine load and some other technological factors.

Known in the art is a large group of electrical governors for controlling the speed of a heat engine based on a positioning electric drive having alternating direction of rotation of the armature comprising an electric drive kinematically connected to a fuel dosing device and electrically connected to a unit comparing the real speed of the heat engine with a preset speed, a unit for forming the program for controlling the heat engine, and a unit for forming a program for controlling the electric drive. The electric drive in these governors may be made in the form of a moment electric motor or a proportional electric magnet (materials of the symposium of "Robert Bosch" Company BRD, published on May 16,1984 (Moscow): report by K. Zimmerman "Diesel Equipment of the "Bosch" Company" (FIGS. 17 and 22), or in the form of a step motor (materials of the "Fridman-Mayer" symposium, Austria, published on Apr. 16, 1984 (Lenigrad): report by F. Pashke "Development of Electronic Governor", pp. 4–5, FIG. 17).

Later on the entire group of positioning electric drives providing alternating rotation of the armature in the process of control will conventionally be called electric motors.

The process of controlling the speed of a heat engine having electric governors of this group is effected as follows. Under steady state conditions, when the heat engine speed is equal to a required speed, no control signal is present at the output of the unit comparing these speeds. As a result, the electric motor armature and the fuel dosing device are in an equilibrium state corresponding to the steady-state load of the heat engine. As soon as the speed of th heat engine deviates from a preset value, e.g. following a change of the load, the comparison unit produces a signal proportional to the difference of the compared speeds. This signal is fed to the electric motor through the control unit forming unit. As a result, the fuel dosing device occupies such a new postion, in which the real and required rotational speeds of the heat engine become equal to each other.

The governors with a positioning electric drive are featured by a low level of utilization of their useful power. This is due to the fact that under steady-state operating conditions of the heat engine, when the fuel dosing device and the associated electric motor armature are stationary, the electric motor operates in a mode close to the braked state of its armature, which is characterized by low efficiency. Therefore, to maintain the rotational speed of the heat engine with a high accuracy, the input power of the electric motor must be increased.

In the above described electrical governors with a positioning electric drive the heat engine speed meter, the electric circuits transmitting information on the heat engine speed, and the unit comparing the measured rotational speed with the preset value set up main feedback of the governors. A fault in the electric circuits in the main feedback line, e.g. due to oxidation of the contacts in plug-and-socket connectors or a break of the wire, result in that the control signal applied to the electric motor and not compensated by the feedback reaches its maximum value, so that the fuel dosing device is set to the maximum feed position, and the heat engine operates in a racing mode. To reduce a probability of heat engine racing, the feedback components are doubled, while the engine energency stop controller is added with various limit and emergency switches for disconnecting the electric controls of the motor. In order to deenergize the control circuit for eliminating the racing mode of the heat engine, the fuel dosing device must be moved towards the fuel cutoff point. This is done by providing the governor with a special spring which creates an additional load on the electric motor and this requires an increase of the input power of this motor still further.

Known in the art is a heat engine speed governor based on a high-speed electric drive (USSR Inventor's Certificate No. 708065 published in bulletin "Otkrytiya, izobreteniya, promyshlennye obraztsy, tovarnye znaki" No. 1, 1980) comprising an electric motor with unilateral direction of rotation kinematically connected to the input shaft of a differential mechanism whose other shaft is rotated by a heat engine while the output shaft thereof is kinematically connected to a fuel dosing device of the heat engine, a channel for controlling the rotational speed of the electric motor, in which the speed meter is electrically connected to the input of control signal forming unit whose setting input is connected to the output of a unit for forming a program of controlling the electric motor speed having a task setting input, an output electriclly connected to the electric motor and a channel for correction of the motor speed under transient operating conditions in response to the heat engine speed connected to the correction input of the unit forming the control signal in the motor speed control channel.

In the described speed governor the input shafts of the differential mechanism are rotated by the heat engine and by the electric motor in opposite directions. When the speed of both shafts is the same, the output shaft of the differential mechanism and the associated fuel dosing device are stationary. When the load on the heat engine or the preset speed of one of the input shafts is changed, the output shaft rotates and moves the fuel dosing device to a postion corresponding to the new load or speed conditions of the heat engine, under which the rotational speeds of the input shaft are the same. The presence of a differential mechanism in the speed governor being discussed makes it possible to use a conventional electric motor of unilateral direction of rotation. In this governor the mechanical transmission from the heat engine shaft to the input shaft of the differential mechanism plays a role of main feedback.

To increase the accuracy of maintaining the rotational speed of the heat engine provided in this governor due to stabilization of the electric motor speed, the speed meter is connected directly to the input of the control signal forming unit. To improve the quality of control of the heat engine speed under transient conditions, i.e. duration of the control process and the value of deviation of the heat engine speed from a predetermined value, the speed meter of the electric motor speed correction channel is coupled to the electric motor and electrically connected to the correction input of the control signal forming unit through the differential mechanism. The unit forming the program for controlling the electric motor speed is a power supply unit, in which the output voltage can be varied thus changing the speed of the electric motor and, therefore, the speed of the heat engine. The control signal forming unit is made as an amplifier.

In the speed governor under discussion the signal from the heat engine speed meter is converted in the differentiating unit; therefore, under steady-state conditions the information on the heat engine speed is not transmitted to the control signal forming unit, while the accuracy of maintaining the heat engine speed depends entirely on the accuracy of maintaining the speed of the electric motor. Such a scheme of the governor, in which the speed of the heat engine is controlled not by deviation of the parameter being controlled but by a parameter indirectly connected with the former, does not provide the required accuracy of maintaining the heat engine speed.

SUMMARY OF THE INVENTION

The basic object of the invention is to provide a speed governor for heat engine having such a channel for controlling the electric motor speed, which would make it possible to effect the control directly by the speed of the heat engine, thus improving the accuracy of maintaining its rotational speed.

This object is attained by providing a heat engine speed governor comprising an electric motor with unilateral direction of rotation kinematically cconnected to the input shaft of a differential mechanism whose other shaft is rotated by a heat engine while the output shaft thereof is kinematically connected to a fuel dosing device of the heat engine. A channel for controlling the rotational speed of the electric motor includes a speed meter electrically connected to the input of the control signal forming unit, whose setting input is connected to the output of a unit for forming a program of control of the electric motor speed having a task setting input and whose output is electriclly connected to the electric motor. A channel correcting the motor speed under transient operating conditions in response to the heat engine speed is connected to the correction input of the unit forming the signal to control the motor speed. According to the invention, the speed meter is connected to the heat engine. The electric motor speed control channel is provided with a comparison unit, one input of which is connected to the speed meter while the other input is connected to the unit forming a program for controlling the electric motor speed; and an integrator whose input is connected to the output of the comparison unit while the output is connected to the input of the control signal forming unit.

The fact that the electric motor speed control channel includes a heat engine speed meter, a comparison unit and an integrator used for signal conversion makes it possible to keep the control signal at a level proportional to the integral of deviation of the heat engine speed from a required value. The integrated error signal reduces the heat engine speed deviation from the preset value so that the engine speed is maintained at high accuracy within a specified tolerance.

BRIEF DESCRIPTION OF THE DRAWING

The invention is further described by way of example with reference to the accompanying drawing showing a block diagram of the heat engine speed governor according to the invention.

DETAILED DESCRIPTION OF THE INVENTION

The heat engine speed governor 1 comprises an electric motor 2 characterized by unidirectional rotation kinematically connected to the input shaft 3 of a differential mechanism 4. The other input shaft 5 of the differential mechanism 4 is rotated by a heat engine 6, which in the embodiment described is kinematically connected to its shaft 7. The output shaft 8 of the differential mechanism 4 is kinematically connected to a fuel dosing device 9 of the heat engine 6. The kinematic couplings of the differential mechanism 4 are shown in the drawing in the form of a gear transmission.

The speed governor 1 also comprises an electric motor speed control channel 10. Mounted at the input of the speed control channel 10 is a heat engine speed meter 11, which in this embodiment consists of a position transducer 12 coupled to the input shaft 5 of the differential mechanism 4 and connected to the input of a converter 13 converting the position of the input shaft into an electric signal. The converter 13 is connected to an input 14 of a comparison unit 15 comparing the heat engine speed with a required speed of the second electric motor. Connected to the input 16 of the comparison unit 15 is the output of a program forming unit 17 forming a program for controlling the speed of the electric motor, said unit 17 being provided with a program input 18. The output of the program forming unit 17 is also connected to the setting input 19 of a control signal forming unit 20.

The output of the comparison unit 15 is connected to the input of an integrator 21 whose, output is connected to the input 22 of the control signal forming unit 20.

Provided at the input 22 of the control siganl forming unit 20 is a threshold element 23 having an input 24 for setting a task determined by the limits of deviation of the rotational speed of the heat engine 6 from a preset value. The output of the threshold element 23 is connected to the input of an electric signal converter 25 whose output is connected to the input 26 of an adder 27 whose other input is the setting input 19 of the control signal forming unit 20. The output of the adder 27 is connected to the input 28 of an adder 29 whose other input is a correction input 30 of the control signal forming unit 20.

The output of the adder 29 is connected to the input of a control signal converter 31 whose, output is connected to the input of a threshold element 32 protecting the electric motor 2 against overloads. The threshold element has an input 33 for setting a task determined by a permissible load of the electric motor 2. The output of the threshold element 32 is an output of the control signal forming unit 20 and is connected to the electric motor 2.

The speed governor 1 also comprises a correction channel 34 for correction of the electric motor speed under transient conditions in response to the speed of the heat engine, at the input of which there is installed a speed meter 11, which is common for the channel 34 and for the speed control channel 10. The output of the heat engine speed meter 11 is connected to the input of a differentiating unit 35 whose output is connected to the input of an electric signal converter 36. The output of the converter 36 is an output of the correction channel 34 and is connected to the correction input 30 of the control signal forming unit 20.

The heat engine speed governor 1 operates as follows. The input shaft 3 of the differential mechanism 4 is rotated by the electric motor 2 at a predetermined speed, while the input shaft 5 is rotated by the shaft 7 of the heat engine 6 in the opposite direction. If the speed of the input shaft 3 is equal to that of the input shaft 5, the output shaft 8 of the differential mecahanism 4 and the associated fuel dosing device 9 are at rest. When the load on the heat engine increases the rotational speed of the shaft 5 decreases and the difference between the speeds of the shafts 3 and 5 results in rotation of the shaft 8, which moves the fuel dosing device 9 for increasing the fuel supply. This increases the speed of the shaft 7 of the heat engine 6 and shaft 5 to a value at which the speed of the shaft 3 becomes equal to that of the shaft 5 and the output shaft 8 with the fuel dosing device 9 stop moving. After that the transient process of speed regulation is over and the heat engine 6 continues to operate under steady-state conditions corresponding to the preset speed of the electric motor 2. The speed of the heat engine 6 with a decreasing load is controlled in a similar manner. In this case the fuel dosing device 9 moves in the direction of reducing the fuel supply. When the electric motor 2 rotates at a speed below the preset value, the equality of speeds of the shafts 3 and 5 is broken so that the shaft 8 and the fuel dosing device 9 move in the direction of reducing the fuel supply until the speed of the shaft 5 connected to the heat engine becomes equal to the newly set speed of the shaft 3 driven by the electric motor 2. The speed of the heat engine 6 in the case of increasing the speed of the electric motor 2 is controlled in a similar way. In this case the fuel dosing device 9 moves for increasing the fuel supply.

Since the shaft 3 and 5 of the differential mechanism 4 are kinematically connected to the electic motor 2 and the heat engine 6 respectively, their speeds have a ratio equal to the transmission ratio of the gearing between the heat engine 6, electric motor 2 and differential mechanism 4. Thus, under steady-state conditions the rotational speed of the heat engine 6 is proportional to the speed of the electric motor 2, while the control of the speed of the heat engine 6 is effected by using the control functions of the electric motor 2.

The electric motor 2 is controlled via the speed control channel 10 in accordance with a program set via the input 18. The input 18 is generally a conbination of inputs through which there are applied signals carrying data on the parameters of the heat engine and the machine unit in which this engine is mounted. Depending on the combination of the data signals fed into the control program forming unit 17 through the input 18, the program for optimum control of the electric motor 2 is formed. In particular, to the input 18 of the unit 17 there may be applied signals characterizing the speed and load of the heat engine 6, the temperature of the cooling liquid, oil, exhaust gases, supercharging pressure, atmospheric pressure, accelerator pedal position, transmission parameters, vehicle speed, distribution of the load between the units operating in parallel, and other parameters. The task signal is fed into the program forming unit 17, which produces signals applied to the setting input 19 of the control signal forming unit 20.

The rotational speed of the heat engine 6 is measured by the meter 11 installed at a place convenient for its mounting and for taking off the signal. In the embodiment described in this specification the meter 11 is mounted within the zone of the input shaft 5 of the differential mechanism 4.

The output signal of the meter 11 is applied to the input 14 of the comparison unit 15. The other input 16 of the comparison unit 15 is fed with a signal formed in the signal forming unit 17. The error signal proportional to the difference between the real speed and the preset speed of the heat engine 6 from the output of the comparison unit 15 is applied to the input of the integrator 21 storing the measurement error.

The output signal of the integrator 21 is applied to the input 22 of the control signal forming unit 20 and then to the threshold element 23, which operates when the signal reaches a predetermined level. The threshold element 23 is adjusted for permissible deviation of the speed of the heat engine 6 from a preset value using the input 24. As soon as the deviation overcomes the permissible value, the integrated signal is fed to the converter 25 in which it is converted in response to the signal fed to the input 19 of the control signal forming unit 20. The signal summed up in the adder 27 is fed through the adder 29, summing up the control and correction signals, to the converter 31, from the output of which the signal, e.g. in the form of timing pulses, is fed to the control windings of the electric motor 2.

The channel 10, heat engine speed meter 11, comparison unit 15 and integrator 21 in combination with the threshold element 23 provided in the speed governor 1 increase the accuracay and stability of the rotational speed of the heat engine 6 under steady-state conditions.

The output signal of the converter 31 is fed through the threshold element 32 to the output of the control signal forming unit 20, from which it is fed to the windings of the electric motor 2. The electric motor 2 can be overloaded in the case of higher friction in the differential mechanism 4, in the electric motor 2 itself and in its fuel dosing device 9. The raised friction not only overloads the electric motor 2 by overheating its windings but in the case of wedging the fuel dosing device 9 can result in racing of the heat engine 6. Therefore, during overloads the threshold element 32 switches off the electric motor 2, which runs to rest thus automatically stopping the heat engine 6. The electric motor 2 is adjusted for a limiting overload by the input 33. The threshold element 32 increases the reliability of the speed governor 1 and that of the heat engine 6 being controlled.

The operation of the speed governor 1 is based on astatic (high-speed) principle of control and this makes it possible to accurately maintain the speed of the heat engine 6 under steady-state operating conditions. On the other hand, the astatic control system have a tendency to self-oscillation. This disadvantage can be eliminated by improving the quality of controlling the speed of the heat engine 6 under transient conditions. This is effected by providing dynamic correction, i.e. by introducing a derivative of the controlled value (speed of the heat engine 6) into the channel 34 correcting the electric motor speed.

The output signal of the heat engine speed meter 11 is fed to the input of the differentiating unit 35. From the unit 35 the correction signal is fed to the converter 36, where it is converted to a type corresponding to the signal at the output of the adder 27. From the output of the converter 36 the converted signal is applied to the correction input 30 of the control signal forming unit 20 and then is fed to the adder 29 which sums up the control and correction signals fed from the adder 27 and the converter 36.

The power supply of the electric motor 2 and the components of the channels 10 and 34 are effected in an ordinaray way by connecting them to the power supply system of the heat engine 6 or to a self-contained power pack.

Thus the claimed governor can operate both under steady-state and transient condition,, features high reliability, low power consumption, simple design and a low cost of the electromechanical part, while providing high accuracy of maintaining a predetermined speed of a heat engine preset within a wide range, and high quality of speed control under transient operating conditions. Depending on the imposed requirements, the governor can be adjusted for permissible instability of the heat engine speed manually or automatically. As a result, the governor turns to be a universal device capable of operating practically in all machines equipped with heat engines.

INDUSTRIAL APPLICATION OF THE INVENTION

The invention can be use in internal combustion engines, turbines and other types of heat engines, preferably in diesel engines of agricultural machinery, diesel automobiles, diesel-electric and turbo-electric units, stationary units, industrial, tractor, road and transport machines and other machine units with heat engines.

We claim:

1. A heat engine speed governor comprising:

an electric motor of unidirectional rotation;

a differential mechanism having a first input shaft kinematically connected to said electric motor, a second input shaft and an output shaft;

a heat engine rotating said second input shaft of said differential mechanism;

a fuel dosing device of the heat engine kinematically connected to said output shaft of said differential machanism;

an electric motor speed control channel, for controlling the rotational speed of the electric motor, comprising a heat engine speed meter, a control signal forming unit, a program forming unit, a comparison unit and an integrator; and a correction channel for correction of the speed of the electric motor under transient operating conditions in response to the speed of the heat engine, and comprising said heat engine speed meter; wherein said heat engine speed meter is connected to the heat engine, measures the rotational speed of the heat engine, and has an input connected to a first input of said electric motor speed control channel and to an input of said correction channel and an output connected to a first output of said correction channel;

said comparison unit having a first input connected to said output of said heat engine speed meter, a second input and an output;

said program forming unit forming a program of controlling the speed of said electric motor and having a program input and an output connected to said second input of said comparison unit;

said control signal forming unit having a setting input connected to said output of said program forming unit, a first input, a correction input connected to said correction channel, and an output electrically connected to said electric motor; and said integrator having an input connected to said output of said comparison unit and an output connected to said first input of said control signal forming unit.

2. A heat engine speed governor according to claim 1, wherein the heat engine speed meter comprises a position transducer coupled to the second input shaft of the differential mechanism; and, a converter converting the position of the second input shaft into an electric signal and having an input connected to the position transducer and an output connected to said output of said heat engine speed meter.

3. A heat engine speed governor according to claim 1, wherein the correction channel further comprises a differentiating unit having an input connected to said output of said heat engine speed meter and an output; and, a converter having an input connected to said output of said differentiating unit and an output connected to a second output of said correction channel and to said correction input of said control signal forming unit.

4. A heat engine speed governor according to claim 2, wherein the correction channel further comprises a differentiating unit having an input connected to said output of said heat engine speed meter and an output; and, a converter having an input connected to said output of said differentiating unit and an output connected to a second output of said correction channel and to said correction input of said control signal forming unit.

5. A heat engine speed governor according to claim 1, wherein the control signal forming unit comprises:

a first threshold element having a first input connected to said first input of said control signal forming unit and said output of said integrator, a second input connected to a second input of said control signal forming unit for setting a tast determined by the limits of deviation of the rotational speed of the heat engine from a preset value, and an output;

an electric signal converter having an input connected to said output of said first threshold element and an output;

a first adder having a first input connected to said output of said electric signal converter, a second input connected to said setting input of said control signal forming unit and to said output of said program forming unit, and an output;

a second adder having a first input connected to said output of said first adder, a second input connected to said correction input of said control signal forming unit and said correction channel, and an output;

a control signal converter having an input connected to said output of said second adder, and an output; and a second threshold element having a first input connected to said output of said control signal converter, a second input connected to a third input of said control signal forming unit for setting a task determined by a permissible load of the electric motor, and an output connected to said output of said control signal forming unit and to said electric motor.

6. A heat engine speed governor according to claim 2, wherein the control signal forming unit comprises:

a first threshold element having a first input connected to said first input of said control signal forming unit and said output of said integrator, a second input connected to a second input of said control signal forming unit for setting a task determined by the limits of deviation of the rotational speed of the heat engine from a preset value, and an output;

an electric signal converter having an input connected to said output of said first threshold element and an output;

a first adder having a first input connected to said output of said electric signal converter, a second input connected to said setting input of said control signal forming unit and to said output of said program forming unit, and an output;

a second adder having a first input connected to said output of said first adder, a second input connected to said correction input of said control signal forming unit and said correction channel, and an output;

a control signal converter having an input connected to said output of said second adder, and an output; and a second threshold element having a first input connected to said output of said conrol signal converter, a second input connected to a third input of said control signal forming unit for setting a task determined by a permissible load of the electric motor, and an output connected to said output of said control signal forming unit and to said electric motor.

7. A heat engine speed governor according to claim 3, wherein the control signal forming unit comprises:

a first threshold element having a first input connected to said first input of said control signal forming unit and said output of said integrator, a second input connected to a second input of said control signal forming unit for setting a task determined by the limits of deviation of the rotational speed of the heat engine from a preset value, and an output;

an electric signal converter having an input connected to said output of said first threshold element and an output;

a first adder having a first input connected to said output of said electric signal converter, a second input connected to said setting input of said control signal forming unit and to said output of said program forming unit, and an output;

a second adder having a first input connected to said output of said first adder, a second input connected to said correction input of said control signal forming unit and said correction channel, and an output;

a control signal converter having an input connected to said output of said second adder, and an output; and a second threshold element having a first input connected to said output of said control signal converter, second input connected to a third input of said control signal forming unit for setting a task determined by a permissible load of the electric motor, and an output connected to said output of said control signal forming unit and to said electric motor.

8. A heat engine speed governor according to claim 4, wherein the control signal forming unit comprises:

a first threshold element having a first input connected to said first input of said control signal forming unit and said output of said integrator, a second input connected to a second input of said control signal forming unit for setting a task determined by the limits of deviation of the rotational speed of the heat engine from a preset value, and an output;

an electric signal converter having an input connected to said output of said first threshold element and an output;

a first adder having a first input connected to said output of said electric signal converter, a second input connected to said setting input of said control signal forming unit and to said output of said program forming unit, and an output;

a second adder having a first input connected to said output of said first adder, a second input connected to said correction input of said control signal forming unit and said correction channel, and an output;

a control signal converter having an input connected to said output of said second adder, and an output; and a second threshold element having a first input connected to said output of said control signal converter, a second input connected to a third input of said control signal forming unit for setting a task determined by a permissible load of the electric motor, and an output connected to said output of said control signal forming unit and to said electric motor.

* * * * *